US007273249B1

(12) United States Patent
Tseng

(10) Patent No.: US 7,273,249 B1
(45) Date of Patent: Sep. 25, 2007

(54) FOLDABLE CHAIR

(75) Inventor: Chuen-Jong Tseng, Chiayi Hsien (TW)

(73) Assignee: Taiwan Shin Yeh Enterprise Co., Ltd., Chiayi Hsien (TW)

( * ) Notice: Subject to any disclaimer, the term of this patent is extended or adjusted under 35 U.S.C. 154(b) by 0 days.

(21) Appl. No.: 11/584,365

(22) Filed: Oct. 20, 2006

(51) Int. Cl.
*A47C 4/00* (2006.01)

(52) U.S. Cl. ..... 297/39; 297/16.1; 297/35

(58) Field of Classification Search ..... 297/27, 297/21, 31, 35, 39, 40, 16.1
See application file for complete search history.

(56) References Cited

U.S. PATENT DOCUMENTS 4,772,068 A * 9/1988 Gleckler et al. ..... 297/39
5,529,270 A * 6/1996 Liu ..... 248/188
5,735,570 A * 4/1998 Tseng ..... 297/39
6,095,596 A * 8/2000 Chen ..... 297/39
6,206,462 B1 * 3/2001 Huang ..... 297/39
6,644,732 B1 * 11/2003 Lin ..... 297/39

* cited by examiner

*Primary Examiner*—Laurie K. Cranmer
(74) *Attorney, Agent, or Firm*—Ladas & Parry LLP

(57) ABSTRACT

A foldable chair includes: a seat supporting frame; a first pivot-pin unit; a first link-plate unit pivoted to the seat supporting frame through the first pivot-pin unit; a pivot joint unit; a backrest pivoted to the first link-plate unit through the pivot joint unit; an armrest unit pivoted to the backrest; a front leg unit pivoted to the seat supporting frame and the armrest unit; a second link-plate unit pivoted to the pivot joint unit; a second pivot-pin unit; a rear leg unit pivoted to the armrest unit and further pivoted to the second link-plate unit through the second pivot-pin unit; a third pivot-pin unit; and a lock-plate unit pivoted to the rear leg unit through the third pivot-pin unit.

4 Claims, 7 Drawing Sheets

FOLDABLE CHAIR

BACKGROUND OF THE INVENTION

1. Field of the Invention

The invention relates to a foldable chair, more particularly to a foldable chair including a lock-plate unit pivotable between locked and unlocked positions when folding and unfolding chair.

2. Description of the Related Art

As shown in FIGS. 1 to 3, a conventional foldable chair includes a seat frame 11, a backrest 12 connected pivotably to the seat frame 11, a pair of spaced apart armrests 13 (only one is shown), a front leg unit 14 connected pivotably to the seat frame 11, a rear leg unit 15 connected pivotably to the armrests 13, a pivot joint unit 16 pivoted to the backrest 12 and the rear leg unit 15, and a locking member 17 sleeved slidably on the rear leg unit 15. The pivot joint unit 16 is formed with an engaging recess 163. The locking member 17 is formed with a locking protrusion 173 that is engageable with the engaging recess 163 in the pivot joint unit 16 so as to prevent folding of the foldable chair (see FIG. 1). When it is desired to fold the foldable chair, the locking member 17 is moved upwardly along the rear leg unit 15 so as to disengage the locking protrusion 173 from the engaging recess 163, thereby permitting folding of the foldable chair. Hence, through sliding movement of the locking member 17, the foldable chair can be locked to and unlocked from its unfolded state. However, for foldable chairs having different designs in the rear legs that are not suitable for mounting of the locking member and/or for sliding movement of the locking member thereon, a different design of the locking member is required.

SUMMARY OF THE INVENTION

The object of the present invention is to provide a foldable chair that includes a lock-plate unit pivotable between locked and unlocked positions instead of the sliding locking member of the aforesaid conventional foldable chair.

Accordingly, a foldable chair of this invention comprises: a seat supporting frame; a first pivot-pin unit defining a first axis; a first link-plate unit pivoted to the seat supporting frame through the first pivot-pin unit; a pivot joint unit defining a joint axis parallel to the first axis; a backrest pivoted to the first link-plate unit through the pivot joint unit; an armrest unit pivoted to the backrest; a front leg unit pivoted to the seat supporting frame and the armrest unit; a second link-plate unit pivoted to the pivot joint unit; a second pivot-pin unit defining a second axis parallel to the first axis and the joint axis; a rear leg unit pivoted to the armrest unit and further pivoted to the second link-plate unit through the second pivot-pin unit; a third pivot-pin unit defining a third axis parallel to the first and second axes and the joint axis; and a lock-plate unit pivoted to the rear leg unit through the third pivot-pin unit so as to be rotatable relative to the rear leg unit between a locked position, in which the lock-plate unit crisscrosses and engages releasably the pivot joint unit, and an unlocked position, in which the lock-plate unit is disengaged from the pivot joint unit.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
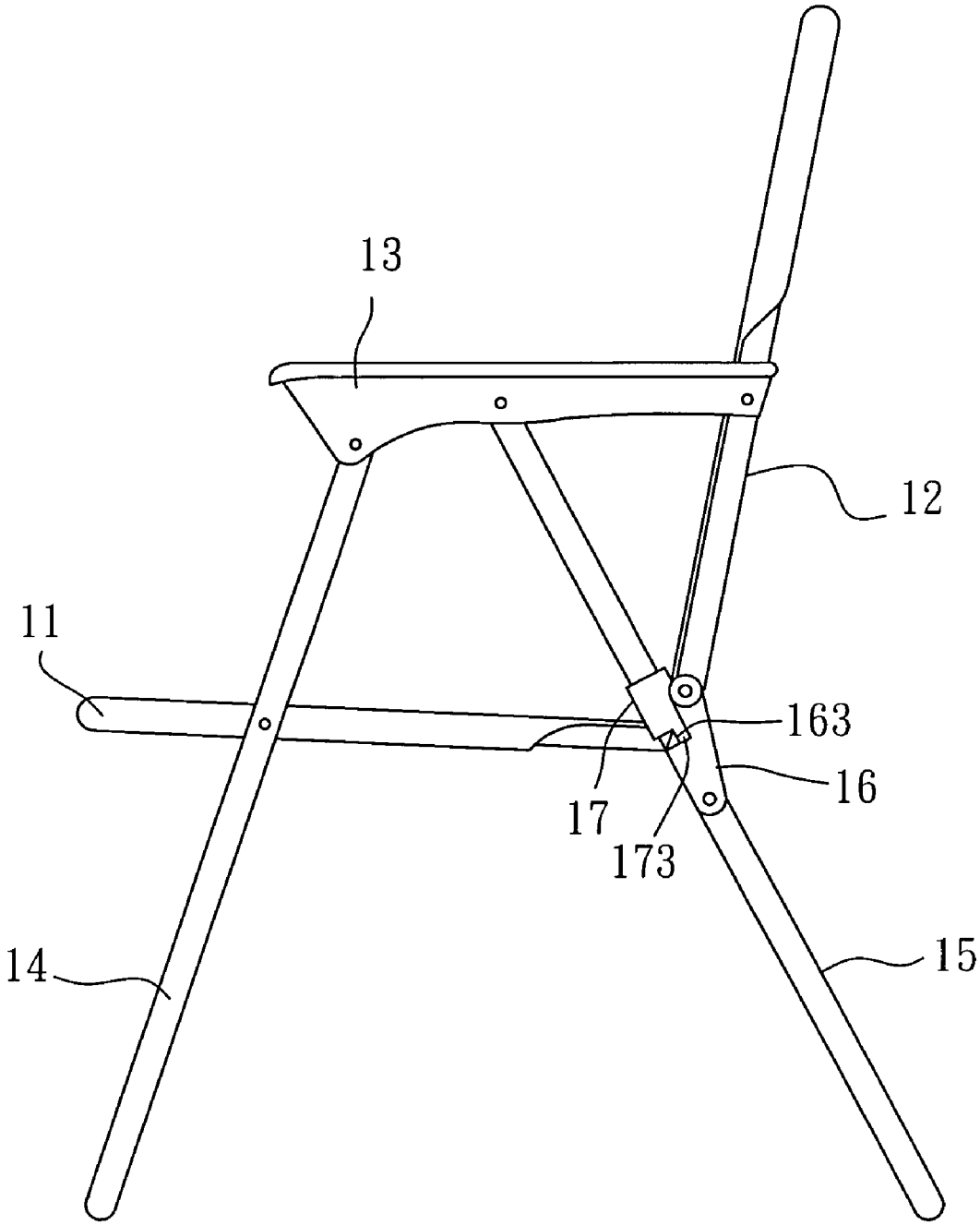
FIG. 1 PRIOR ART
FIG. 1 is a schematic view of a conventional foldable chair in an undolded state.
Figure 2:
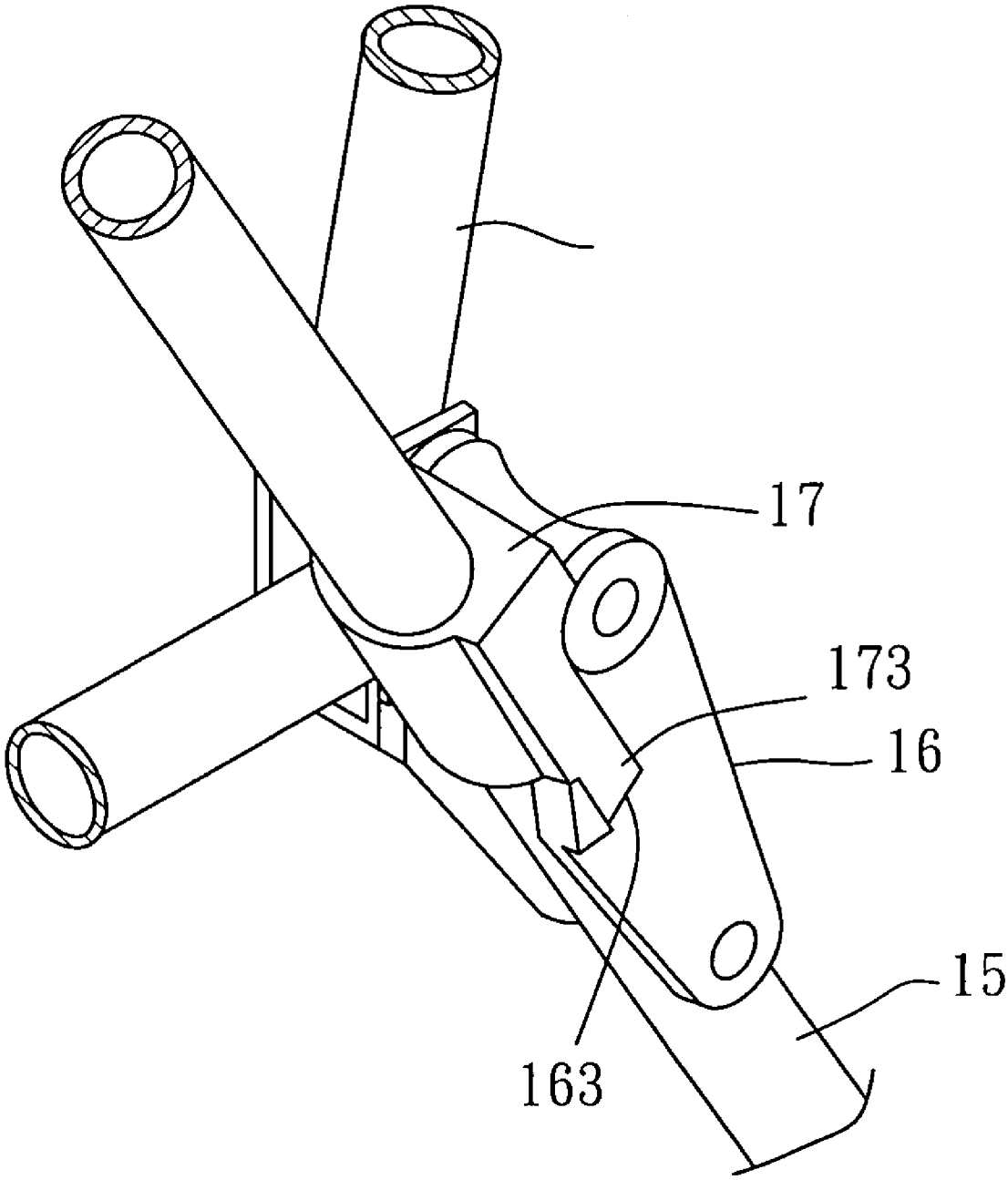
FIG. 2 PRIOR ART
FIG. 2 is a fragmentary perspective view illustrating the engagement between a locking member and a pivot joint unit.
Figure 3:
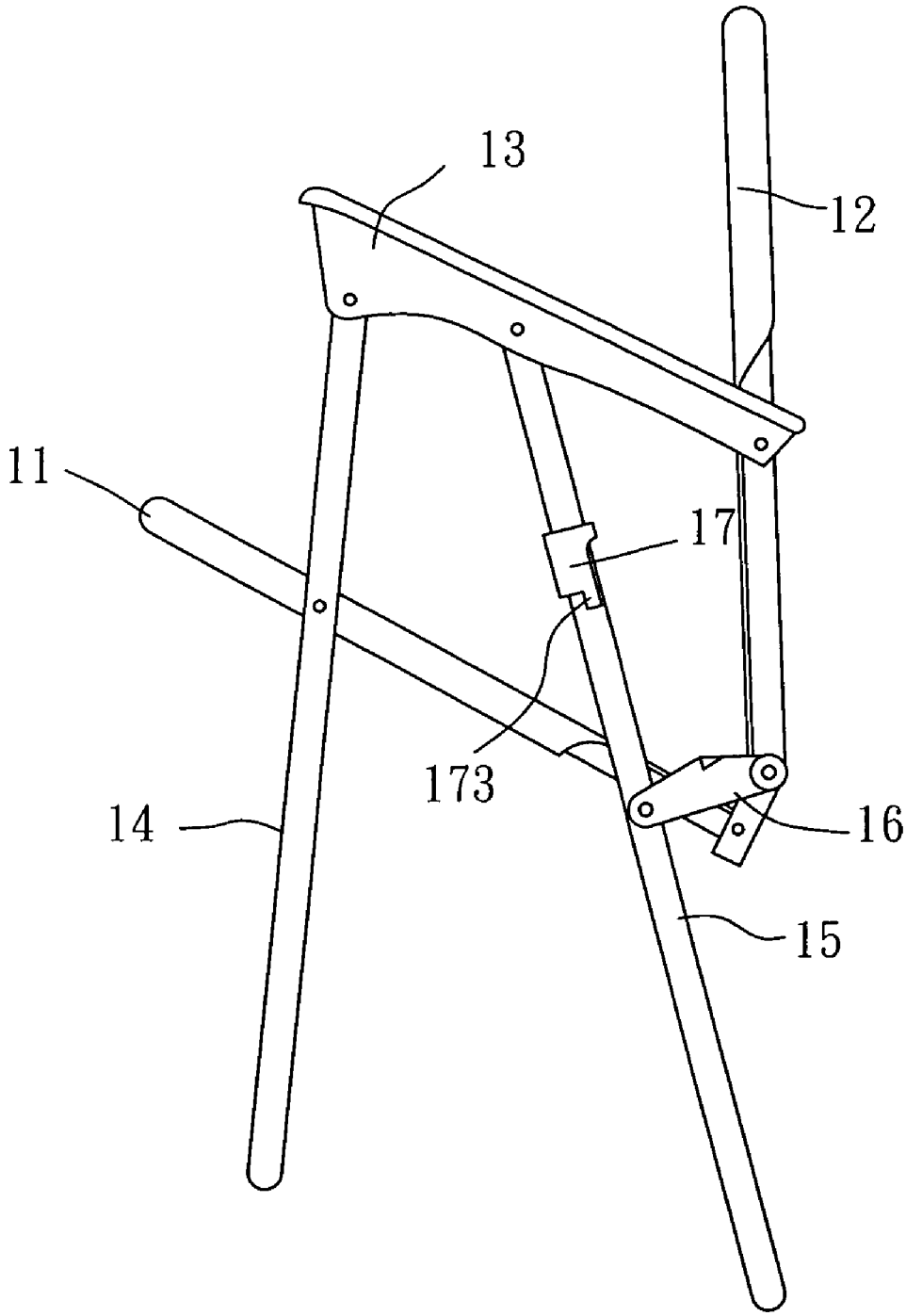
FIG. 3 PRIOR ART
FIG. 3 is a schematic view illustrating a state where the conventional foldable chair is being folded.
Figure 4:
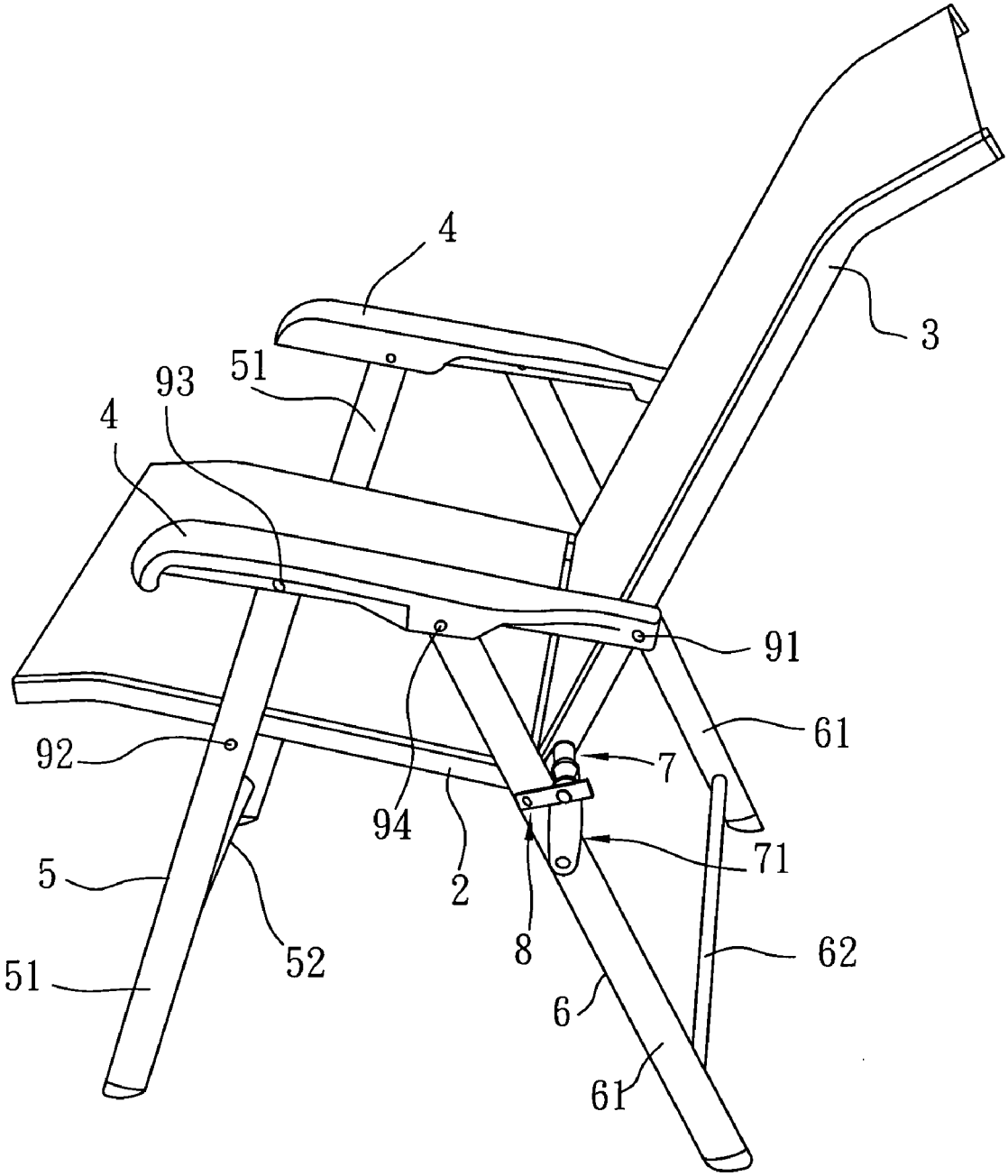
FIG. 4 is an assembled perspective view of the preferred embodiment of a foldable chair according to the present invention.
Figure 5:
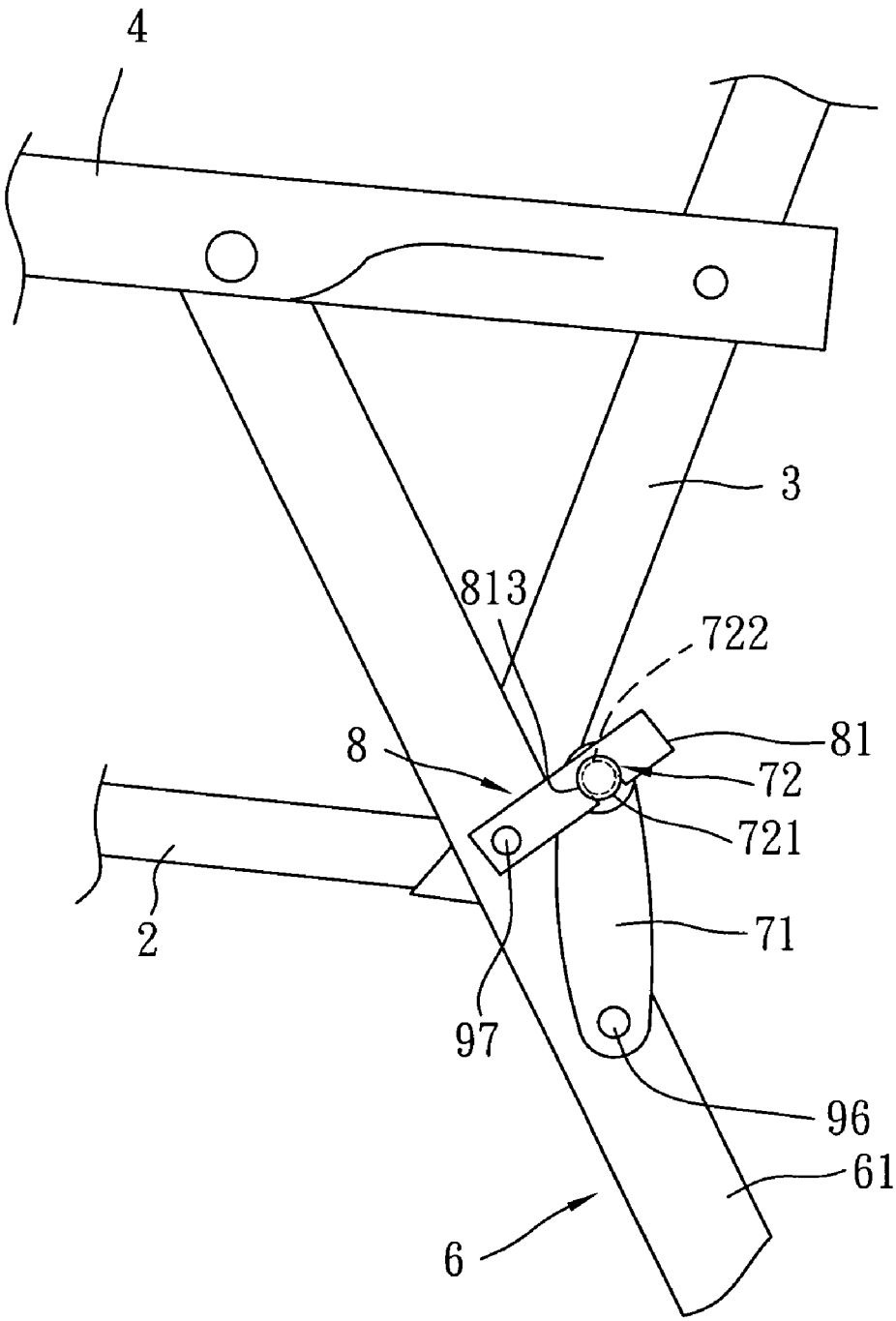
FIG. 5 is a fragmentary schematic view of the preferred embodiment, illustrating a state where a lock-plate unit is disposed at a locked position.
Figure 6:
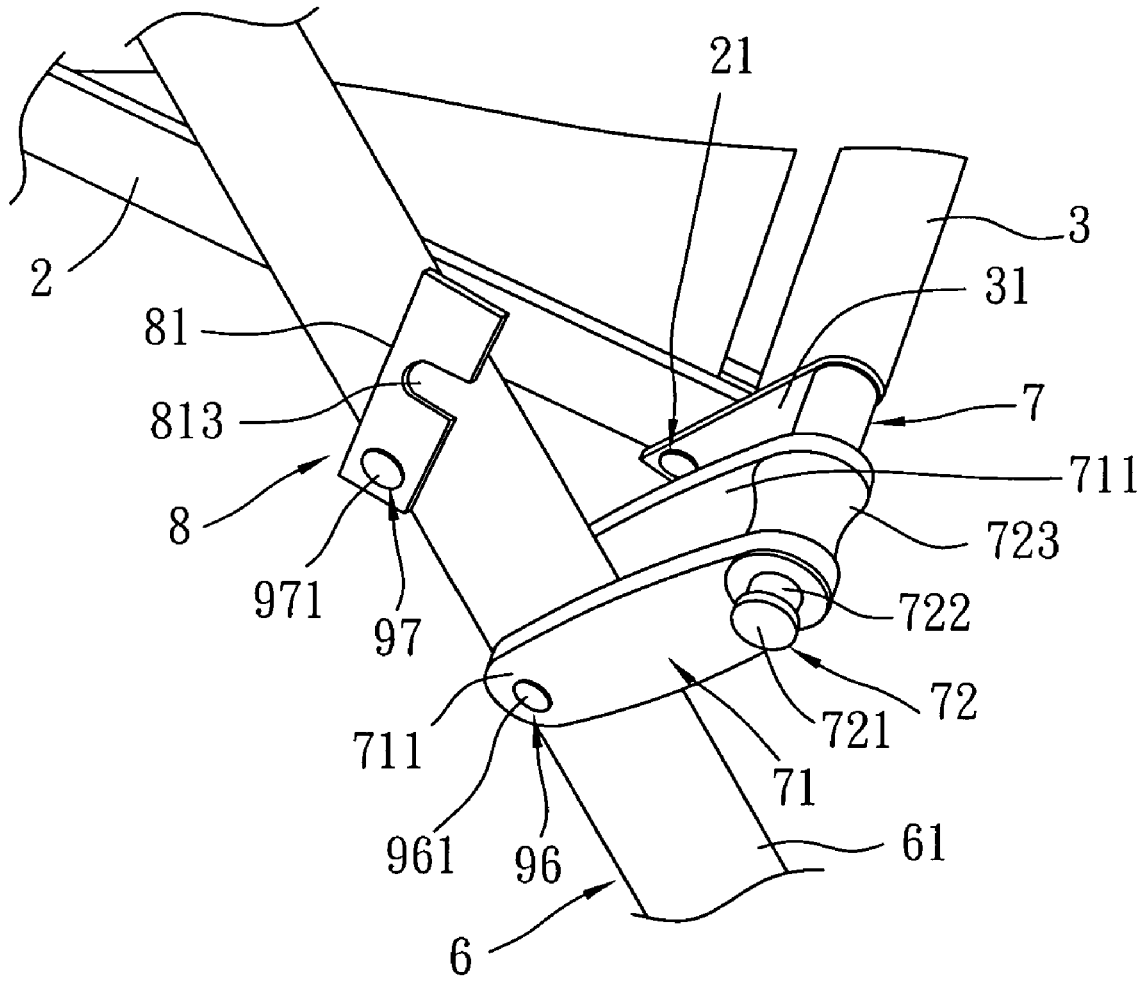
FIG. 6 is a fragmentary perspective view of the preferred embodiment, illustrating another state where the lock-plate unit is disposed at an unlocked position.

Referring to FIGS. 4 to 6, the preferred embodiment of a foldable chair according to the present invention comprises: a seat supporting frame 2; a first pivot-pin unit 21 defining a first axis; a first link-plate unit 31 pivoted to the seat supporting frame 2 through the first pivot-pin unit 21; a pivot joint unit 7 defining a joint axis parallel to the first axis; a backrest 3 pivoted to the first link-plate unit 31 through the pivot joint unit 7; an armrest unit 4 pivoted to the backrest 3 through a first pivot 91; a front leg unit 5 pivoted to the seat supporting frame 2 through a second pivot 92 and to the armrest unit 4 through a third pivot 93; a second link-plate unit 71 pivoted to the pivot joint unit 7; a second pivot-pin unit 96 defining a second axis parallel to the first axis and the joint axis; a rear leg unit 6 pivoted to the armrest unit 4 through a fourth pivot 94 and further pivoted to the second link-plate unit 71 through the second pivot-pin unit 96; a third pivot-pin unit 97 defining a third axis parallel to the first and second axes and the joint axis; and a lock-plate unit 8 pivoted to the rear leg unit 6 through the third pivot-pin unit 97 so as to be rotatable relative to the rear leg unit 6 between a locked position (see FIGS. 4 and 5), in which the lock-plate unit 8 crisscrosses and engages releasably the pivot joint unit 7, and an unlocked position (see FIGS. 6 and 7), in which the lock-plate unit 8 is disengaged from the pivot joint unit 7.

As shown in FIG. 5, the lock-plate unit 8 engages releasably the pivot joint unit 7 in a tongue-and-groove engaging manner when the lock-plate unit 8 is disposed at the locked position.

In this embodiment, the rear leg unit 6 includes a pair of rear legs 61 and a rear connecting rod 62 interconnecting the rear legs 61. The front leg unit 5 includes a pair of front legs 51 and a front connecting rod 52 interconnecting the front legs 51. The third pivot-pin unit 97 includes a pair of third pivot pins 971 (only one is shown). The lock-plate unit 8 includes a pair of locking plates 81 (only one is shown), each of which is formed with an engaging groove 813, and each of which is pivoted to a respective one of the rear legs 61 through a respective one of the third pivot pins 97. The pivot joint units 7 includes a pair of pivot joints 72 (only one is shown), each of which has a headed end 721 and a neck 722 reduced in cross-section from the headed end 721 and engaging the engaging groove 813 in a respective one of the locking plates 81.

The second pivot-pin unit 96 includes a pair of second pivot pins 961 (only one is shown). The second link-plate unit 71 includes left and right pairs of link-plates 711 (only one pair is shown). Each of the left and right pairs of the link-plates 711 is pivoted to a respective one of the rear legs 61 through a respective one of the second pivot pins 961. Each of the pivot joints 72 has a middle portion 723 interconnecting pivotably a respective one of the left and right pairs of the link-plates 71.

Figure 7:
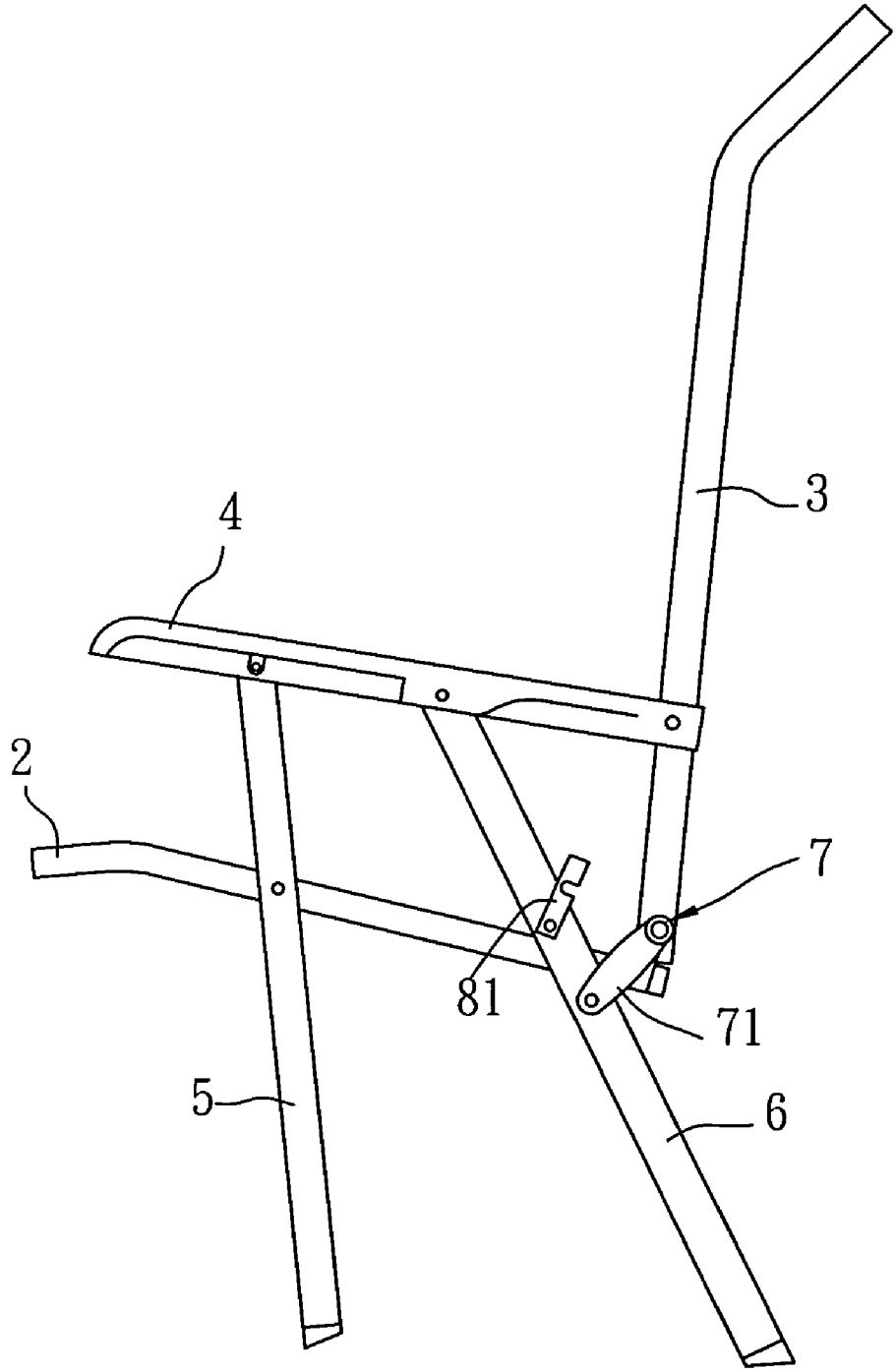
FIG. 7 is a schematic view illustrating a state where the foldable chair of the preferred embodiment is being folded.

As best illustrated in FIG. 4, the foldable chair is retained in an unfolded state when the locking plates 81 are disposed at the locking positions. When it is desired to fold the foldable chair, the locking plates 81 are rotated away from the pivot joints 72 such that the engaging grooves 813 in the locking plates 81 are disengaged from the necks 722 of the pivot joints 72, thereby permitting folding of the foldable chair, as best illustrated in FIG. 7.

Since the locking plates 81 of the foldable chair of this invention are pivoted to the rear legs 61, the rear legs 61 have more flexible designs as compared to the aforesaid conventional foldable chair.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A foldable chair comprising:

a seat supporting frame;

a first pivot-pin unit defining a first axis;

a first link-plate unit pivoted to said seat supporting frame through said first pivot-pin unit;

a pivot joint unit defining a joint axis parallel to said first axis;

a backrest pivoted to said first link-plate unit through said pivot joint unit;

an armrest unit pivoted to said backrest;

a front leg unit pivoted to said seat supporting frame and said armrest unit;

a second link-plate unit pivoted to said pivot joint unit;

a second pivot-pin unit defining a second axis parallel to said first axis and said joint axis;

a rear leg unit pivoted to said armrest unit and further pivoted to said second link-plate unit through said second pivot-pin unit;

a third pivot-pin unit defining a third axis parallel to said first and second axes and said joint axis; and a lock-plate unit pivoted to said rear leg unit through said third pivot-pin unit so as to be rotatable relative to said rear leg unit between a locked position, in which said lock-plate unit crisscrosses and engages releasably said pivot joint unit, and an unlocked position, in which said lock-plate unit is disengaged from said pivot joint unit.

2. The foldable chair as claimed in claim 1, wherein said lock-plate unit engages releasably said pivot joint unit in a tongue-and-groove engaging manner when said lock-plate unit is disposed at said locking position.

3. The foldable chair as claimed in claim 2, wherein said rear leg unit includes a pair of rear legs, said third pivot-pin unit including a pair of third pivot pins, said lock-plate unit including a pair of locking plates, each of which is formed with an engaging groove, and each of which is pivoted to a respective one of said rear legs through a respective one of said third pivot pins, said pivot joint unit including a pair of pivot joints, each of which has a headed end and a neck reduced in cross-section from said headed end and engaging said engaging groove in a respective one of said locking plates.

4. The foldable chair as claimed in claim 3, wherein said second pivot-pin unit includes a pair of second pivot pins, said second link-plate unit including left and right pairs of linking plates, each of said left and right pairs of said linking plates being pivoted to a respective one of said rear legs through a respective one of said second pivot pins, each of said pivot joints interconnecting pivotably a respective one of said left and right pairs of said linking plates.

* * * * *